US007017674B2

(12) United States Patent
Bell et al.

(10) Patent No.: US 7,017,674 B2
(45) Date of Patent: Mar. 28, 2006

(54) METHOD OF CHANGING OPERATING CHARACTERISTICS OF AN IMPLEMENT

(75) Inventors: James M. Bell, Clayton, NC (US); Raymond T. Schenck, Morrisville, NC (US); Paul A. Dvorak, Sanford, NC (US); Mark A. Sporer, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 88 days.

(21) Appl. No.: 10/715,712

(22) Filed: Nov. 17, 2003

(65) Prior Publication Data

US 2005/0102865 A1 May 19, 2005

(51) Int. Cl.
*A01B 41/06* (2006.01)

(52) U.S. Cl. ..... 172/2; 172/817; 37/232

(58) Field of Classification Search ..... 37/348, 37/382, 195, 232; 172/2, 3, 4.5, 6, 817; 414/699; 701/50

See application file for complete search history.

(56) References Cited

U.S. PATENT DOCUMENTS

| | | | | |
|---|---|---|---|---|
| 4,123,907 | A | 11/1978 | Bianchetta et al. | |
| 4,244,389 | A | 1/1981 | Shimoura et al. | |
| 4,949,805 | A * | 8/1990 | Mather et al. | 180/333 |
| 5,092,408 | A * | 3/1992 | Tatara et al. | 172/2 |
| 5,425,431 | A | 6/1995 | Brandt et al. | |
| 5,525,043 | A | 6/1996 | Lukich | |
| 5,577,876 | A | 11/1996 | Haeder et al. | |
| 5,590,731 | A | 1/1997 | Jacobson | |
| 5,937,832 | A | 8/1999 | Kapich | |
| 5,937,833 | A | 8/1999 | Kapich | |
| 5,951,258 | A | 9/1999 | Lueschow et al. | |
| 5,957,213 | A | 9/1999 | Loraas et al. | |
| 5,967,756 | A | 10/1999 | Devier et al. | |
| 6,135,230 | A * | 10/2000 | Schenck et al. | 180/273 |
| 6,148,548 | A * | 11/2000 | Tohji | 37/348 |
| 6,148,688 | A * | 11/2000 | Nishimaki | 74/493 |
| 6,186,260 | B1 | 2/2001 | Schenck et al. | |
| 6,282,891 | B1 | 9/2001 | Tsai | |
| 6,308,516 | B1 | 10/2001 | Kamada | |
| 6,314,727 | B1 | 11/2001 | Prabhu et al. | |
| 6,321,535 | B1 | 11/2001 | Ikari et al. | |
| 6,347,517 | B1 | 2/2002 | Sereni | |
| 6,542,789 | B1 * | 4/2003 | Ufheil | 700/275 |
| 6,694,240 | B1 * | 2/2004 | Swick et al. | 701/50 |
| 6,736,216 | B1 * | 5/2004 | Savard et al. | 172/1 |
| 6,757,993 | B1 * | 7/2004 | Kondou | 37/348 |
| 6,820,356 | B1 * | 11/2004 | Naruse et al. | 37/348 |

FOREIGN PATENT DOCUMENTS

JP 60-109433 * 6/1985

* cited by examiner

*Primary Examiner*—Victor Batson

(57) ABSTRACT

Changing operating characteristics of an implement can expand the capabilities of and enhances the productivity of the implement. The disclosed method and apparatus for changing operating characteristics of an implement comprises, providing the operating characteristics of the implement with a predetermined operational range consisting of a plurality of values, connecting the implement with a work machine, sending a first input signal identifying the operational range to an electronic control module, operating the implement at a first value within the operational range, sending a second input signal relating to a second value within the operational range to the electronic control module, and sending an output signal from the electronic control module to one of the work machine and the implement to change from the first value to the second value.

20 Claims, 3 Drawing Sheets

METHOD OF CHANGING OPERATING CHARACTERISTICS OF AN IMPLEMENT

TECHNICAL FIELD

This invention relates generally to changing operating characteristics of an implement, and, more particularly, to a method and apparatus for identifying the operational range of the operating characteristics of the implement and changing the operating characteristics within the operational range.

BACKGROUND

Work machines such as integrated tool carriers, skid steer loaders, backhoe loaders, excavators, and a wide variety of other work machines typically have a plurality of hydraulically controlled implements that may be interchangeably attached to the work machine to perform a particular work function. These implements are normally controlled through an implement control system having one or more hydraulic systems that are used to actuate and control the implement's lift mechanism, tilt mechanism, or auxiliary mechanisms. These implements are likewise controlled through the use of various operator input devices such as one or more implement control levers, foot pedals, or joysticks. Many of these implements have a need for changeable operating characteristics. For example, a stump grinder needs to be able to increase its hydraulic flow rate so as to increase the cutting head speed when grinding a very hard stump. It is, therefore, beneficial to have the ability to change the operating characteristics of an implement.

One known method of changing the operating condition of an implement of a power machine is described in U.S. Pat. No. 5,957,213 issued to Loraas et. al. on Sep. 28, 1999. It discloses a power machine and an implement suitable for attachment to the power machine, the implement including an electronic controller attached thereon and a power actuator removably attached thereto. The implement with the electronic controller attached thereto is configured to control the power actuator based on operator input signals from operator inputs. Having an implement with an electronic controller restricts the flexibility of the operation of the work machine by restricting the use of implements with the power machine to only those that have the electronic controller. Dependency on the electronic controller being attached to the implement requires that either the implement be manufactured or retrofitted with the electronic controller. Both of these requirements will increase the overall cost of the implement as compared to an implement that does not require the electronic controller to be attached thereto.

The present invention is directed to overcoming one or more of the problems as set forth above.

SUMMARY OF THE INVENTION

The present invention is a method for changing operating characteristics of an implement, comprising providing the operating characteristics of the implement with a predetermined operational range consisting of a plurality of values, connecting the implement with a work machine, sending a first input signal identifying the operational range to an electronic control module, operating the implement at a first value within the operational range, sending a second input signal relating to a second value within the operational range to the electronic control module, and sending an output signal from the electronic control module to one of the work machine and the implement to change from the first value to the second value.

In another aspect of the present invention, a work machine is provided comprising a connectable implement having operating characteristics with a predetermined operational range consisting of a plurality of values, an electronic control module attached to the work machine, a first-end portion of a conducting device attached to the work machine, a second-end portion of the conducting device attached to the implement, wherein the attachment of the conducting device with the electronic control module and implement sets operation of the implement at a first value within the operational range, and signal means for changing from the first value within the operational range to a second value within the operational range.

BRIEF DESCRIPTION OF THE DRAWINGS

For a better understanding of the present invention, reference may be made to the accompanying drawings in which.

DETAILED DESCRIPTION

Figure 1:
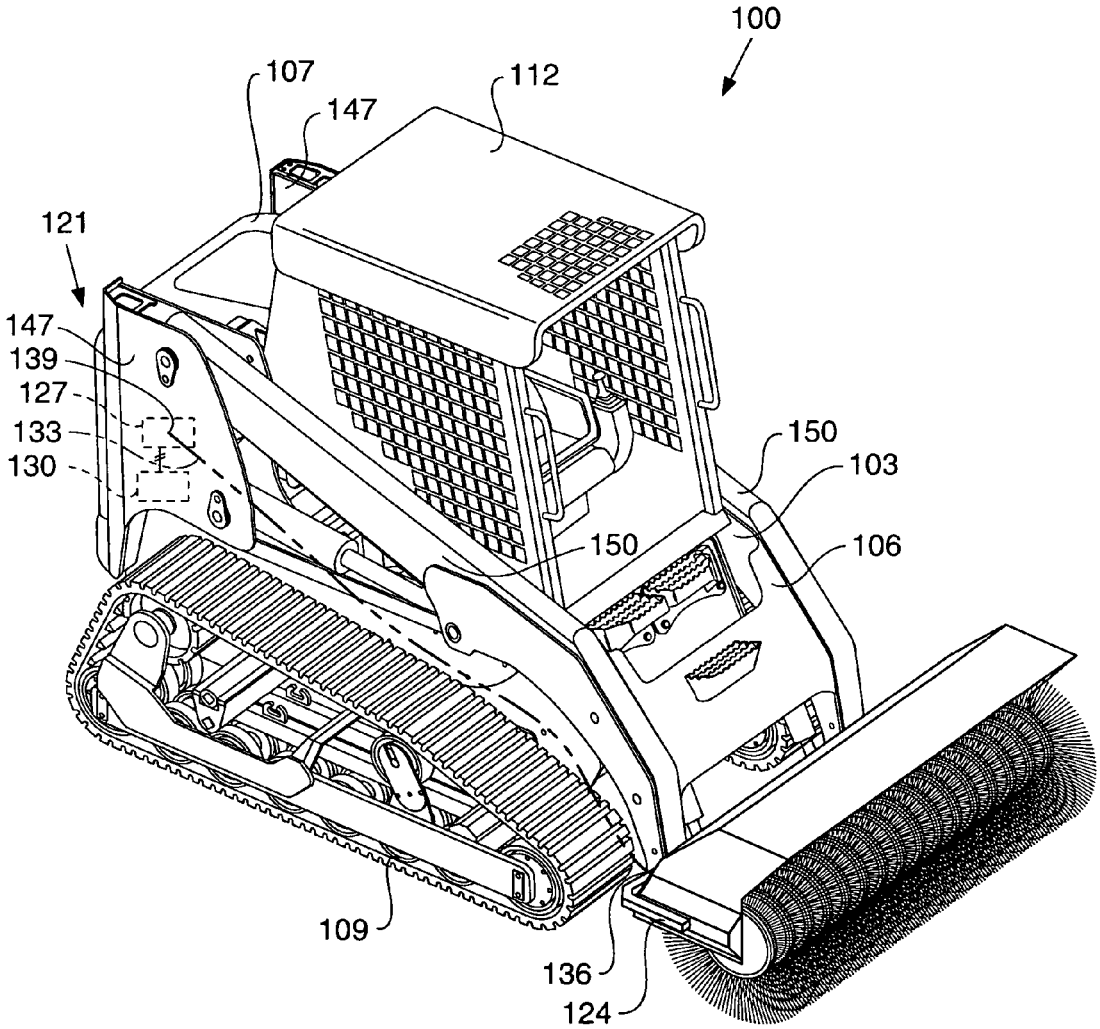
FIG. 1 is a side view of a work machine, such as a tracked skid steer loader, incorporating the apparatus for changing operating characteristics of a work machine.

Referring to the drawings, a method and apparatus for changing operating characteristics of an implement for use with a work machine 100 is shown. With particular reference to FIG. 1, the work machine 100 is depicted as a tracked skid steer loader. It should be understood, however, that the work machine 100 could be any sort of work machine that has hydraulically controlled implements that are removably attached thereto and not just those enumerated above. The work machine 100 has a body portion 103 having a front-end portion 106 and a rear-end portion 107. The work machine includes a plurality of ground engaging support members 109 that support the body portion 103 and an operator's compartment 112 supported on the body portion 103. Further, the work machine 100 includes a lift member assembly 121 pivotally attached to the body portion 106 and an implement 124 pivotally connectable with the lift member assembly 121. The implement 124 has operating characteristics having a predetermined operational range consisting of a plurality of values, including a predetermined operational range of hydraulic characteristics. The work machine 100 also includes an electronic control module 127 and a hydraulic system 130 both of which are attached to the work machine 100 and are connected to one another as shown by truncated wires in FIGS. 1 and 3. Finally, the work machine 100 includes a conducting device such as a ground wire 133 having a first-end portion 136 connectable with the implement 124 and a second-end portion 139 connected to the electronic control module 127. It should be understood, however, that the conducting device might also be a cable, wire, rod, or other such mechanism.

Figure 2:
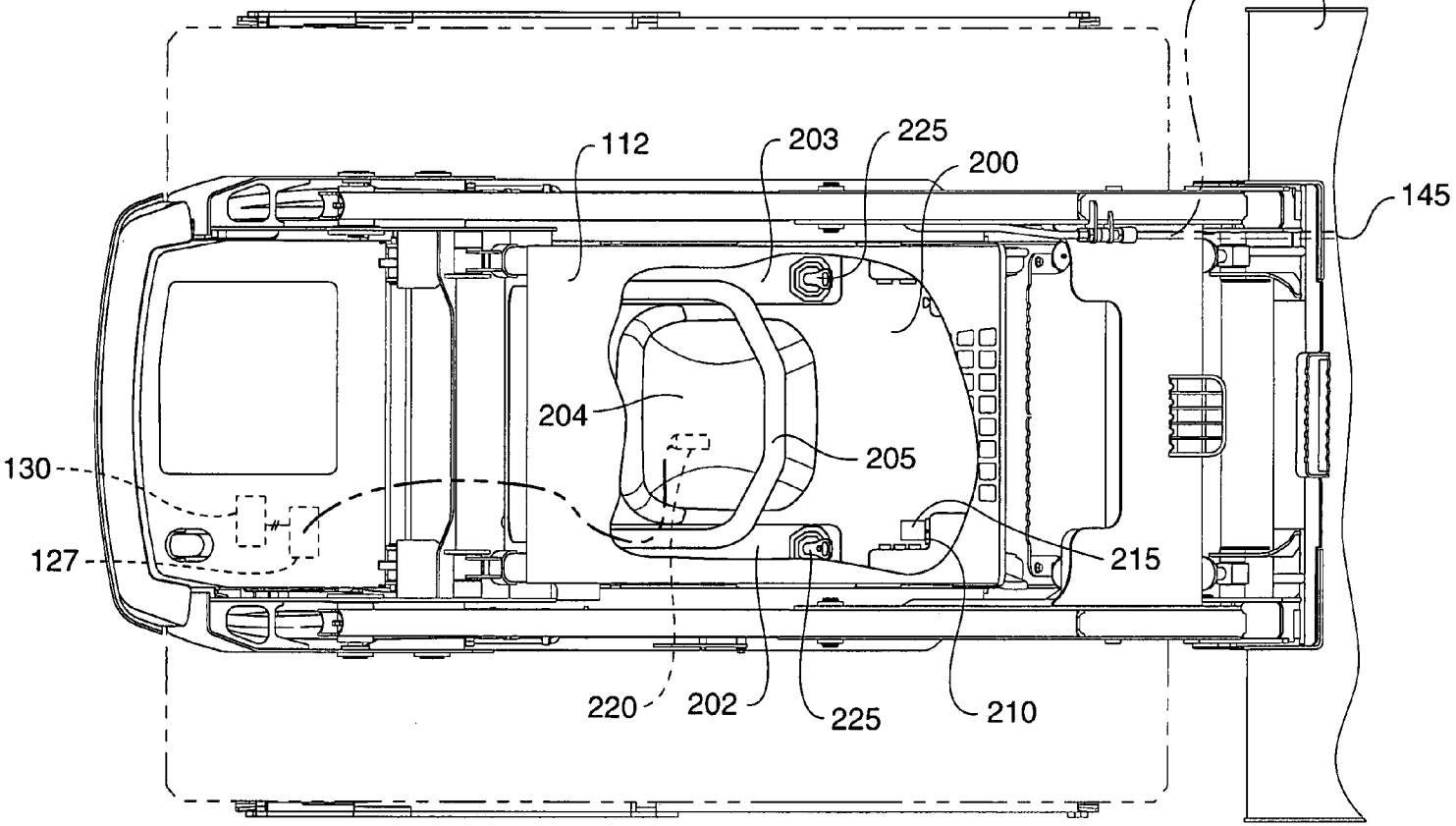
FIG. 2 is a top view the work machine, including a top view of an operator's compartment thereof.

As depicted in FIG. 2, the implement 124 includes at least one hydraulic hose 142 having a first-end portion 145 connectable with the implement 124 and a second-end portion (not shown) connected to the hydraulic system 130.

Although a broom is depicted in FIGS. 1 and 2, it should be understood that the implement 124 could be any hydraulically controlled implement with operational characteristics having a predetermined operational range, including an auger, broom, stump grinder, cold planer, or any other such implement. Further, it should be understood that the hydraulic operational characteristics could include hydraulic pressures, hydraulic flow rates, or any other hydraulic characteristic.

Further, in FIG. 1, the lift member assembly 121 includes a pair of laterally spaced side members 147 located at the rear-end portion 107 of the body portion 103 and a pair of lift arms 150 pivotally attached to the laterally spaced side members 147. The implement 124 is pivotally connectable with the lift arms 150 at the front-end portion 106 of the body portion 103.

Referring further to FIG. 2, the operator's compartment 112 has a bottom portion 200 and a first side portion 202 and a second side portion 203. The operator's compartment 112 includes a seat 204 attached to the bottom portion 200. The seat 204 includes an armrest 205 that is moveable between up and down positions so that when an operator (not shown) of the work machine 100 is seated in the seat 204 the armrest 205 can be moved into the down position to restrain the operator in the seat 204. The operator's compartment 112 also includes an instrument panel 210 located on the first side portion 202 adjacent the seat 204. The instrument panel 210 includes an operator input device such as a switch 215, lever, or other similar mechanism located thereon such that the operator can request a change in the operating characteristics of the implement 124 by actuating the switch 215. The operator's compartment 112 further includes at least one sensor 220 located therein and operably coupled to the electronic control module 127 such that the sensor 220 can sense when an operator is seated in the seat 204 or when the armrest 205 is in the down position or both. Such a system is described in greater detail in U.S. Pat. No. 6,186,260 B1, entitled: "ARM REST/SEAT SWITCH CIRCUIT FOR USE AS AN OPERATIONAL STATE SENSOR FOR A WORK MACHINE," issued to Schenck et al. and assigned to the assignee of this application. It should be understood that, alternatively, a first sensor may be used to sense when the operator is seated in the seat 204 and a second sensor may be used to sense when the armrest 205 is in the down position. Finally, the operator's compartment 112 includes an additional pair of operator input devices such as a pair of joysticks 225 located adjacent to the seat 204 and attached to the first side portion 202 and the second side portion 203 of the operator's compartment 112.

Figure 3:
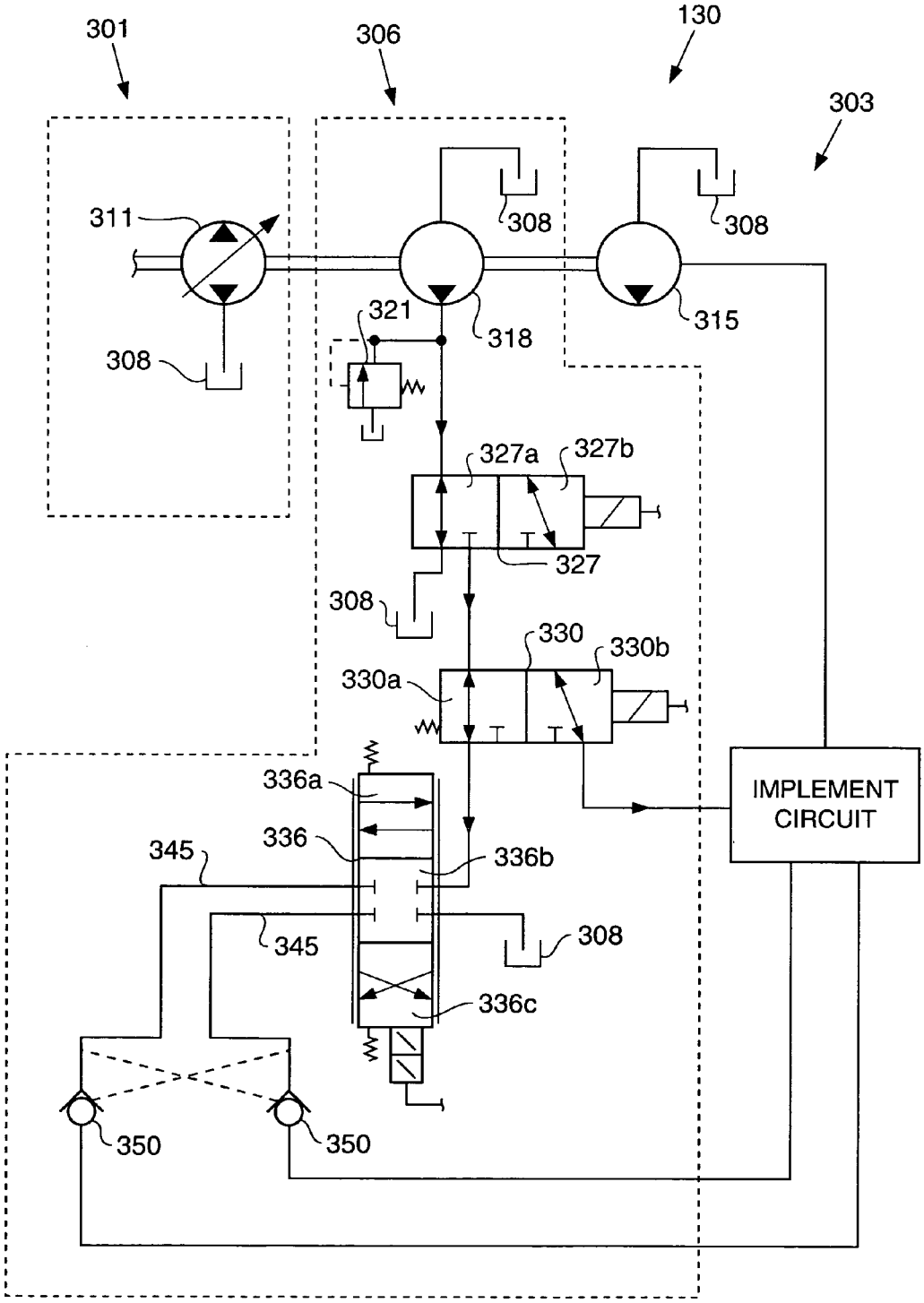
FIG. 3 is a partial diagrammatic and a partial schematic representation of a hydraulic system of the work machine incorporating the present invention.

As depicted in FIG. 3, the hydraulic system 130 includes a portion of a propel hydraulic circuit 301, an implement hydraulic circuit 303, a boost hydraulic circuit 306, and a reservoir, such as a tank 308. The propel circuit 301 includes a first source of pressurized fluid, such as a variable displacement pump 311 in fluid communication with the tank 308.

The implement circuit 303 fluidly controls the lift and tilt functions of the implement 124 as well as the auxiliary functions. Auxiliary functions may include the vertical or horizontal rotation of the implement 124 in any direction, the clamping of an implement, or any other function. The implement circuit 303 includes a second source of pressurized fluid, such as a first fixed displacement pump 315. The first fixed displacement pump 315 is connected with the variable displacement pump 311 and both are in fluid communication with the tank 308.

The boost circuit 306 includes a third source of pressurized fluid, such as a second fixed displacement pump 318. The second fixed displacement pump 318 is also connected with the variable displacement pump 311 and both are in fluid communication with the tank 308. The boost circuit 306 further includes a two-position boost flow diverter valve 327 connected with the second fixed displacement pump 318 with a relief valve 321 interposed thereto. When the boost flow diverter valve 327 is in a first position 327*a*, the pressurized fluid returns to tank 308. When the boost flow diverter valve 327 is in a second position 327*b*, the pressurized fluid flows to a two-position boost flow control valve 330. When the boost flow control valve 330 is in a first position 330*a* it is in a "proportional flow" position and the pressurized fluid flows to an auxiliary control valve 336. When the boost flow control valve 330 is in a second position 330*b* it is in a "full flow" position and the pressurized fluid flows to the implement circuit 303 to change the value of the hydraulic flow rate and hydraulic pressure of the auxiliary function of the implement 124 from a first value to a selected second value, e.g., to increase the hydraulic flow rate and hydraulic pressure to the selected second value. The auxiliary control valve 336 mentioned above is an infinitely variable valve having a first position 336*a*, a second position 336*b*, and a third position 336*c*. When the auxiliary control valve 336 moves toward the first position 336*a* a proportional amount of pressurized fluid flows through conduits 345 in a first direction so as to change the value of the hydraulic flow rate and hydraulic pressure of the auxiliary function of the implement 124 from a first value to a second value. The proportional amount of pressurized fluid is directly related to the distance toward the first position 336*a* the auxiliary control valve 336 moves. When the auxiliary control valve 336 is moved to the second position 336*b* pressurized fluid flow is blocked. Finally, when the auxiliary control valve 336 moves toward the third position 336*c* a proportional amount of pressurized fluid flows in an opposite direction of the first direction of the first position 336*a* so as to change the value of the hydraulic flow rate and hydraulic pressure of the auxiliary function of the implement 124 from a first value to a second value. The proportional amount of pressurized fluid is directly related to the distance toward the third position 336*c* the auxiliary control valve 336 moves. A pair of check valves 350, each located in the conduit 345, blocks all flow of the pressurized fluid when the auxiliary control valve 336 is in the second position 336*b*.

INDUSTRIAL APPLICABILITY

The method of changing operating characteristics of the implement 124 includes connecting the implement 124 to the work machine 100 by connecting the implement 124 to the lift arms 150, connecting the first-end portion 136 of the ground wire 133 with the implement 124, and thus connecting the implement 124 to the electronic control module 127. The operator then climbs into the operator's compartment 112, sits in the seat 204, and lowers the armrest 205 to the down position. The operator then starts-up the work machine 100 so that it is in an operable condition.

Once the operator has started the work machine 100, the electronic control module 127 sends a signal to the implement 124 through the ground wire 133 requesting information as to the implement's 124 operating characteristics' operational range characteristics, in particular the implement's 124 hydraulic characteristics' operational range such as its hydraulic flow rate range and hydraulic pressure range. The implement 124 sends a first input signal back to the electronic control module 127 through the ground wire 133 advising it of the implement's 124 operating characteristics' operational range. Once this is accomplished, based upon the first input signal, the implement 124 begins operation at a first value within the operational range such as operating at a first value of hydraulic flow rate and hydraulic pressure.

When the operator desires to change the implement's 124 operating characteristics the operator will actuate the switch 215 on the instrument panel 210 requesting the change. Before the operating characteristics can be changed, however, at least one predetermined condition must be met. In this embodiment, the predetermined conditions are the work machine 100 must be in operable condition and the operator must actuate switch 215. In order for the work machine 100 to be in an operable condition, the operator must be seated in the seat 204 and the armrest 205 must be in the down position. When the sensor 220 senses that the operator is in the seat 204 and the armrest 205 is in the down position and the operator has actuated the switch 215, the predetermined conditions have been met and a second input signal is sent from the work machine 100 to the electronic control module 127 requesting a change in the implement's 124 operating characteristics. For example, if the operator desires to control the hydraulic characteristics of the hydraulic system 130 such as increasing the hydraulic flow rate and hydraulic pressure, the operator can request such by actuating the switch 215 and having the work machine 100 in the operable condition. In other words, if the operator is using an implement such as the broom 124 depicted in FIG. 1, and the operator encounters heavier debris and the current rotational speed of the broom 124 is not sufficient, the operator can increase the hydraulic flow rate and hydraulic pressure to accelerate the rotational speed of the broom 124 by actuating the switch 215 and having the work machine 100 in the operable condition, thus brushing away the heavier debris.

Once the electronic control module 127 receives the second input signal signifying that the work machine 100 is in operable condition and that the operator desires a change in the operating characteristics, the electronic control module 127 sends an output signal to either the work machine 100 or the implement 124 to change the operating characteristics of the implement 124. For example, the electronic control module 127 receives the second input signal then sends the output signal to the implement 124 to change the hydraulic characteristics of the hydraulic system 130 by increasing the hydraulic flow rate and hydraulic pressure. This is accomplished by responsively interfacing the hydraulic system 130 with the second input signal. More specifically, this is accomplished by responsively interfacing the boost flow diverter valve 327, boost flow control valve 330, and the auxiliary control valve 336 with the second input signal. The electronic control module 124 sends a signal to the boost circuit 306 to activate the boost flow diverter valve 327. Pressurized fluid from the second fixed displacement pump 318 is then sent to the boost flow control valve 330.

When the boost flow diverter valve 327 is in the first position 327*a* the boost flow circuit 306 is not activated and the implement 124 does not receive increased hydraulic flow or hydraulic pressure. To vary the operating characteristics, the boost flow diverter valve 327 must be in the second position 327*b*. When the boost flow control valve 327 is actuated so that it is in the second position 327*b* and the boost flow control valve 330 is actuated so that it is in the second position 330*b*, the boost flow circuit 306 is at "full flow" and the pressurized fluid from the second fixed displacement pump 318 flows to the implement circuit 303 so as to change from the first value to the second value, e.g., increase the implement's hydraulic flow rate and hydraulic pressure. When the boost flow diverter valve 327 is in the second position 327*b* and the boost flow control valve 330 is in the first position 330*a*, the boost flow circuit is at "proportional flow" and the pressurized fluid from the second fixed displacement pump 318 flows to the infinitely variable auxiliary control valve 336. When the infinitely variable auxiliary control valve 336 is in the second position 336*b*, the boost flow circuit 306 is not activated and the implement 124 does not receive increased hydraulic flow or hydraulic pressure. When the infinitely variable auxiliary control valve 336 is actuated so that it moves toward the first position 336*a* or the third position 336*c*, a proportional amount of the pressurized fluid flows to the implement circuit 303 so as to proportionally increase the implement's 124 hydraulic flow rate and hydraulic pressure. The amount of increase is related directly to the amount of movement of the infinitely variable auxiliary valve 336 toward the first position 336*a* or the third position 336*c*.

As described herein, the present method of changing operating characteristics of an implement has particular utility in any work machine 100 that operates with a plurality of different implements 124 or where a particular implement 124 functions under different operating characteristics.

Other aspects, objects and advantages of the invention can be obtained from a study of the drawings, the disclosure and the appended claims.

What is claimed is:

1. A method for changing operating characteristics of an implement for use with a work machine, the method comprising:

providing the operating characteristics of the implement with a predetermined operational range consisting of a plurality of values;

connecting the implement with the work machine;

sending a first input signal identifying the operational range to an electronic control module;

operating the implement at a first value within the operational range after attaching the implement with the work machine;

sending a second input signal relating to a second value within the operational range to the electronic control module; and sending an output signal from the electronic control module to one of the work machine and the implement to change from the first value to the second value.

2. The method of claim 1, wherein sending the first and second input signals to the electronic control module includes:

sending the first input signal from a first source; and sending the second input signal from a second source different from the first source.

3. The method of claim 2, wherein sending the first input signal from the first source and sending the second input signal from the second source includes:

sending the first input signal from the implement; and sending the second input signal from the work machine.

4. The method of claim 1, wherein sending the output signal from the electronic control module includes:

controlling hydraulic characteristics within a hydraulic system having a hydraulic circuit.

5. The method of claim 4, wherein controlling the hydraulic characteristics includes:

attaching the hydraulic system with the electronic control module;

sending the second input signal when at least one predetermined condition has been met;

and responsively interfacing the hydraulic circuit with the second input signal when the at least one predetermined condition has been met.

6. The method of claim 5, wherein responsively interfacing the hydraulic circuit includes:

responsively interfacing a boost flow diverter valve and a boost flow control valve within the hydraulic circuit with the second signal when the at least one predetermined condition has been met.

7. The method of claim 6, wherein controlling hydraulic characteristics within the hydraulic system includes:

controlling hydraulic flow rate and hydraulic pressure of the hydraulic system.

8. The method of claim 7, wherein responsively interfacing the boost flow diverter valve and the boost flow control valve with the second signal includes:

actuating the boost flow diverter valve and the boost flow control valve to change the hydraulic flow rate and hydraulic pressure of the hydraulic system.

9. The method of claim 1, wherein sending the first input signal identifying the operational range includes:

attaching the electronic control module to the work machine;

connecting a first-end portion of a conducting device with the implement; and connecting a second-end portion of the conducting device with the electronic control module.

10. The method of claim 1, wherein sending the second input signal includes:

attaching a seat on the work machine, the seat having an armrest moveable between up and down positions;

sensing when an operator is seated in the seat; and sensing when the armrest is in the down position.

11. A method for changing operating characteristics of an implement for use with a work machine, the method comprising:

connecting the implement with the work machine, the operating characteristics of the implement having a predetermined operational range consisting of a plurality of values for operating at a first value within the operational range;

sending a first input signal identifying the operational range to an electronic control module after attaching the implement with the work machine;

sending a second input signal relating to a second value within the operational range to the electronic control module after the first input signal is sent to the electronic control module; and sending an output signal from the electronic control module to one of the work machine and implement to change from the first value to the second value after the second input signal is sent to the electronic control module.

12. The method of claim 11, wherein sending the first and second input signal and the output signal include:

controlling hydraulic characteristics within a hydraulic system having a hydraulic circuit.

13. The method of claim 12, wherein controlling hydraulic characteristics within the hydraulic system includes:

controlling hydraulic flow rate and hydraulic pressure of the hydraulic system.

14. The method of claim 13, wherein sending the output signal from the electronic control module to one of the work machine and the implement to change from the first value to the second value includes:

sending a signal to the hydraulic system to increase the hydraulic flow rate and hydraulic pressure.

15. The method of claim 13, wherein sending the second input signal includes:

attaching a seat on the work machine, the seat having an armrest moveable between up and down positions;

sensing when an operator is seated in the seat; and sensing when the armrest is in the down position.

16. A work machine, comprising:

a connectable implement having operating characteristics with a predetermined operational range consisting of a plurality of values;

an electronic control module attached to the work machine;

a first-end portion of a conducting device attached to the work machine;

a second-end portion of the conducting device attached to the implement, wherein the attachment of the conducting device with the electronic control module and implement sets operation of the implement at a first value within the operational range; and signal means for changing from the first value within the operational range to a second value within the operational range.

17. The work machine of claim 16, wherein the signal means includes:

a first input signal identifying the first value within the operational range sent from the implement to the electronic control module;

a second input signal relating to a second value within the operational range sent to the electronic control module; and an output signal sent from the electronic control module to one of the work machine and the implement to change from the first value to the second value.

18. The work machine of claim 17, wherein the implement includes changeable hydraulic characteristics within a hydraulic system having a hydraulic circuit.

19. The work machine of claim 18, wherein the hydraulic circuit includes a boost flow diverter valve and a boost flow control valve, wherein the second input signal interfaces with the boost flow diverter valve and the boost flow control valve when at least one predetermined condition is met.

20. The work machine of claim 19, wherein the means for sending the output signal includes means for sending a signal to the boost flow diverter valve and the boost flow control valve to increase hydraulic flow rate and hydraulic pressure of the hydraulic system.

* * * * *

UNITED STATES PATENT AND TRADEMARK OFFICE

CERTIFICATE OF CORRECTION

PATENT NO. : 7,017,674 B2
APPLICATION NO. : 10/715712
DATED : March 28, 2006
INVENTOR(S) : James M. Bell et al.

It is certified that error appears in the above-identified patent and that said Letters Patent is hereby corrected as shown below:

Title Page, Item (73) Assignee: please delete "Caterpillar Inc., Peoria, IL (US)" and insert the following: -- Caterpillar S.A.R.L., Geneva, Switzerland --

Title Page, Item (74) please add the following names regarding Attorney, Agent, or Firm:
--Todd A. Benni--

Signed and Sealed this

Twenty-sixth Day of June, 2007

JON W. DUDAS
*Director of the United States Patent and Trademark Office*